US005305367A

United States Patent [19]

Mulder

[11] Patent Number: 5,305,367

[45] Date of Patent: * Apr. 19, 1994

[54] DEVICE FOR SLIT RADIOGRAPHY WITH IMAGE EQUALIZATION

[75] Inventor: Hendrik Mulder, Delft, Netherlands

[73] Assignee: B.V. Optische Industrie "De Oude Delft", Delt, Netherlands

[ * ] Notice: The portion of the term of this patent subsequent to Aug. 22, 2006 has been disclaimed.

[21] Appl. No.: 697,711

[22] Filed: May 9, 1991

Related U.S. Application Data

[63] Continuation of Ser. No. 435,424, Nov. 1, 1989, Pat. No. 5,062,129.

[30] Foreign Application Priority Data

May 12, 1987 [NL] Netherlands ..... 8701122

[51] Int. Cl.[5] ..... G21K 3/00

[52] U.S. Cl. ..... 378/146; 378/116; 378/19

[58] Field of Search ..... 378/146, 145, 19, 116; 250/385.1

[56] References Cited

U.S. PATENT DOCUMENTS

| | | | |
|---|---|---|---|
| 4,859,855 | 8/1989 | Vlasbloem | 250/385.1 |
| 4,947,416 | 8/1990 | McFaul et al. | 250/385.1 |
| 4,956,557 | 9/1990 | Vlasbloem | 250/385.1 |
| 5,062,129 | 10/1991 | Mulder | 378/156 |

*Primary Examiner*—David P. Porta
*Assistant Examiner*—Don Wong
*Attorney, Agent, or Firm*—Louis E. Marn

[57] ABSTRACT

There is disclosed an assembly for slit radiography with image equalization, comprising a two-dimensional dosimeter for detecting the amount of X-rays transmitted through a body. During a scan different parts of the dosimeter detect the transmitted X-rays. Thereto a system of essentially parallel electrodes is present. The parallel electrodes extend in the direction of scanning and are connected to a control device for forming control signals for the adsorption device.

14 Claims, 3 Drawing Sheets

DEVICE FOR SLIT RADIOGRAPHY WITH IMAGE EQUALIZATION

This is a continuation of U.S. application Ser. No. 07/435,424, filed Nov. 1, 1989 now U.S. Pat. No. 5,062,129.

The invention relates to a device for slid radiography with image equilization, comprising an X-ray source which scan a body for examination via a slit of a slit diaphragm with a flat, fan-shaped X-ray beam over a scanning path in a direction transverse to the lengthwise direction of the slit for forming an X-ray shadowgraph on an X-ray detector; an absorption device which under the control of control signals can influence the fan-shaped X-ray beam per sector thereof, in order to permit control of the X-ray radiation falling in each sector on the body to be examined; and detection means which are designed to detect the quantity of X-ray radiation transmitted by the body instantaneously per section during a scanning movement of the X-ray beam and to convert it into corresponding signals.

Such a device is known, for example from Dutch Patent Application 8400845, which has been laid open for inspection. The known device can have as the X-ray detector an oblong X-ray image intensifier tube which carries out a scanning movement synchronized with the X-ray beam or, for example, a large stationary X-ray screen which is scanned in strips by the flat fan-shaped X-ray beam to form a complete X-ray shadow image of (part of) the body to be examined. In the case of a device intended for making thorax photographs such a large X-ray screen has, for example, dimensions of 40 cm×40 cm.

According to the older Dutch Patent Application 8503152 and the older Dutch Patent Application 8503153, an elongated dosimeter for ionizing radiation can be used for the detection of the quantity of radiation transmitted by the body to be examined instantaneously and per sector. For this purpose, the known dosimeters also carry out a scanning movement in synchronization with the scanning movement of the X-ray beam in such a way that at any instant in the scanning movement the X-ray radiation transmitted by the body for examination also passes through the dosimeter.

For this purpose, special means are needed to ensure that the dosimeter can make a scanning movement along the desired path, and to ensure that the scanning movement of the dosimeter does in fact take place in synchronization with the X-ray beam.

According to Dutch Patent Applications 8503152 and 8503153, it is possible to use for this purpose an arm which carries the X-ray source, the slip diaphragm and the absorption device, and which can swivel about the X-ray focus of the X-ray source. The end of the arm facing away from the X-ray source is then connected to the dosimeter.

An object of the invention is to provide a device for slit radiography in which no special means are needed to make a dosimeter or other detection means physically carry out a scanning movement.

Another object of the invention is to limit the number of moving parts of a device for slit radiography with image equilization.

According to the invention, a device of the above-described type is to this end characterized in that the detection means comprise a two-dimensional dosimeter for ionizing radiation which is placed beyond the body to be examined, is of a width corresponding to the width of the flat, fan-shaped X-ray beam at that point and a height corresponding to the total scanning distance, and which has at least one system of essentially parallel electrodes extending in the direction of scanning and connected to a control device for forming control signals for the absorption device, and has at least one counter electrode.

The invention will be explained in greater detail below with reference to the appended drawing showing a number of examples of embodiments.

Figure 1:
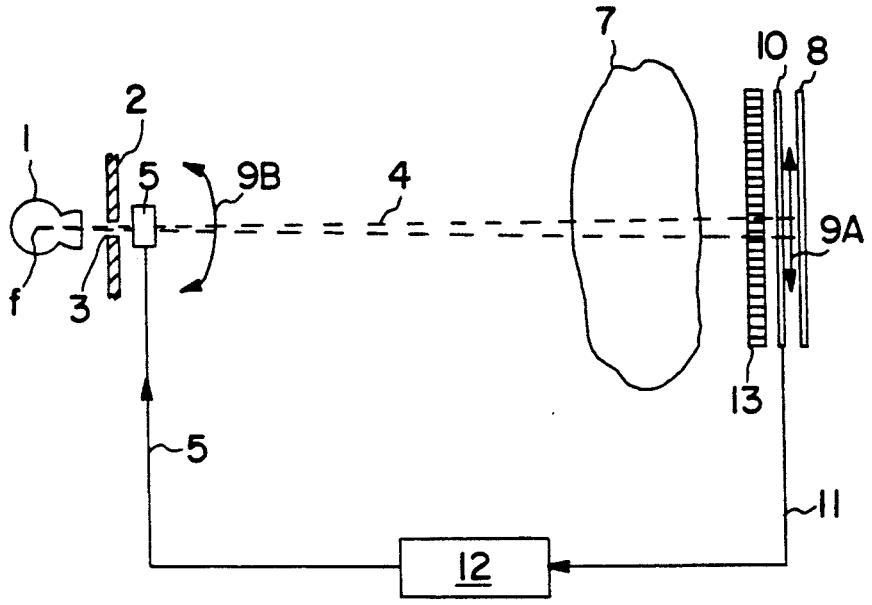
FIG. 1 shows schematically an example of a device according to the invention.

FIG. 1 shows schematically an embodiment of a device according to the invention. The illustrated device for slit radiography with image equilization comprises an X-ray source 1 with an X-ray focus f. Placed in front of the X-ray source is a slit diaphragm 2 with a slit 3 which in operation transmits an essentially flat fan-shaped X-ray beam 4. An absorption device 5 which can influence the fan-shaped X-ray beam per section thereof is also present. The absorption device is controlled by control signals fed in via a line 6.

In operation, the X-ray beam 4 irradiates a body 7 to be examined. An X-ray detector 8 is placed behind the body 7 for recording the X-ray shadowgraph. The X-ray detector 8 can be a large screen cassette, as shown in FIG. 1, but is can also be, for example, a moving oblong X-ray image intensifier.

In order to show the whole body 7, or at least a part thereof to be examined, such as the thorax, on the X-ray detector, the flat X-ray beam in operation makes a scanning movement, as shown schematically by an arrow 9*a*. For this purpose, the X-ray source together with the slit diaphragm 2 and the absorption device 5 can be arranged so that they swing relative to the X-ray focus f, as indicated by an arrow 9*b*. It is, however, also possible to scan a body for examination in another way with a flat X-ray beam, for example by making the X-ray source, together with or without the slit diaphragm, carry out a linear movement.

Positioned between the body 7 and the X-ray detector 8 are detection assembly 10, which are designed to detect instantaneously per sector of the fan-shaped beam 4 the amount of radiation transmitted by the body and to convert it into corresponding electrical signals which are fed via an electrical connection 11 to a control device 12 which forms control signals for the absorption device 5 from the input signals. According to the invention, the detection assembly 10 comprises a two-dimensional stationary dosimeter extending essentially parallel to the X-ray detector or the plane in which the latter describes a scanning movement. The dosimeter is of such dimensions that it covers the entire area scanned by the flat X-ray beam during operation. The dosimeter is described above as a two-dimensional dosimeter. This term is not mathematically correct, but the thickness of the dosimeter viewed in the direction of the X-ray radiation is relatively low. The expression two-dimensional is used to distinguish it from the strip type dosimeters according to the older Dutch Patent Applications 8503152 and 8503153, which in principle cover in a stationary state only a narrow strip-like part of the area to be examined and can thus be described as one-dimensional dosimeters.

In devices for slit radiography in which a stationary X-ray detector such as a large screen cassette is used, in order to reduce the effect of stray radiation on the final picture, use is generally made of an additional slit-type stray radiation diaphragm which makes a scanning movement in synchronization with the X-ray beam between the body being examined and the X-ray detector. Although such a stray radiation diaphragm can also in principle be used in a device for slit radiography according to the invention, the advantage of a non-moving dosimeter would thereby be to some extent lost.

In a device according to the invention, it is therefore advantageous to use an anti-diffusing grid which is known per se and is also known as a Bucky diaphragm, and which is preferably placed between the body for examination and the two-dimensional dosimeter, in order to reduce both the influence of stray radiation on the picture and the influence of stray radiation on the output signals from the dosimeter, and thus again indirectly on the picture. FIG. 1 shows such an anti-diffusing grid at 13.

Figure 2:
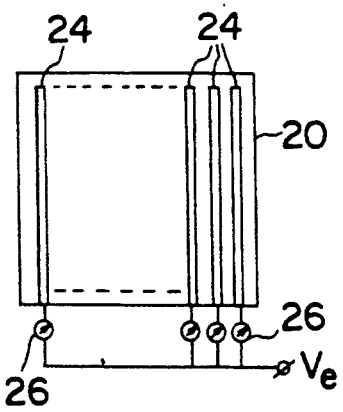
FIG. 2 shows schematically in front view a dosimeter for a device according to the invention.
Figure 3:
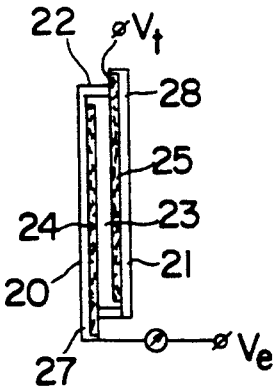
FIG. 3 shows a cross section of a dosimeter according to FIG. 2.

FIGS. 2 and 3 show further details of a suitable two-dimensional dosimeter for a device according to the invention.

The dosimeter shown comprises two parallel walls 20 and 21 which are positioned opposite each other a small distance apart, and which together with an essentially rectangular frame 22 form a suitable measuring chamber 23. The measuring chamber is filled with gas, for example with argon and methane or with xenon at approximately atmospheric pressure. At least the large walls 20 and 21 of the dosimeter are made of material with a high transmission for X-ray radiation, such as, for example perspex or glass.

In addition, one large wall, in the example shown the wall 20, is provided on the inside with a system of parallel strip-type electrodes 24 extending in the scanning direction of the X-ray beam 4. On the inside of the opposite wall 21 there is also a counterelectrode 25, which covers essentially the entire inside surface of the wall 21. In a practical situation, the counterelectrode can have dimensions of, for example, 40 cm×40 cm.

The strip-type electrodes in operation carry a fixed voltage Ve, and the counter electrode carries a fixed voltage Vt, so that a fixed voltage difference Ve−Vt prevails between the strip-type electrodes and the counterelectrode.

If the measuring chamber is irradiated by X-ray radiation, ionization will occur in the gas in the measuring chamber. If Ve is positive in relation to Vt, the positive particles which have arisen in the process will move to the electrode 25, while the negative particles will move to the strip-type electrodes. The opposite happens if Vt is positive relative to Ve. In the case of a measuring chamber filled with Xe, the voltage difference may be, for example, 600 V.

Since the charged particles which have arisen through ionization always move to the nearest electrode with the correct potential, the radiation quantity distribution in a direction at right angles to the strip-type electrodes can be determined by measurement of the current flowing in each of the strip-type electrodes.

In operation, the strip-type electrodes extend in the scanning direction of the flat fan-shaped X-ray beam, so that the currents generated in the various strip-type electrodes indicate the quantity of X-ray radiation transmitted by the body for examination instantaneously per sector of the fan-shaped X-ray beam.

FIG. 2 shows schematically current meters 26 for measurement of the currents generated in the strip-type electrodes 24. In reality, detection of the current intensity in each of the electrodes and conversion of the measured value into suitable signals takes place in the device 12.

the electrodes can be formed in a simple manner by evaporation of conducting material onto an insulating carrier, or by etching away parts of a layer of conducting material on an insulating carrier.

The electrodes can also be formed by applying by means of a sputter technique, for example, a thin layer of nickel to the desired places on an insulating plate of, for example, perspex. In both cases very thin electrodes which virtually do not attenuate the X-ray radiation can be provided.

The electrodes and the walls on which the electrodes are disposed can advantageously extend along at least one edge of the dosimeter beyond the frame 22. For the wall 20 with the strip-type electrodes 24 this is shown in FIG. 3 at 27, and for the wall 21 with the single electrode 25 at 28. In this way the required electronic connections can be made in a simple manner. An ordinary printed circuit board connector could, for example, be used for this.

Figure 4:
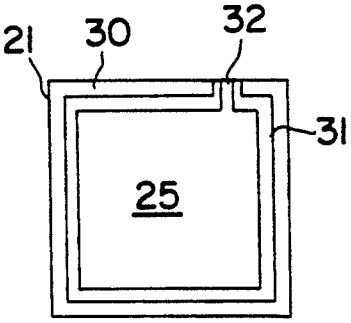
FIG. 4 shows a modification of FIG. 3.

The flat electrode 25 is preferably surrounded by a guard electrode, as shown in FIG. 4.

In FIG. 4 a guard electrode 30, which an, for example, be earthed, surrounds the flat electrode 25. The guard electrode extends along the edge of the wall 21 and lies outside the area of the wall 21 which is directly opposite the strip-type electrodes 24. The guard electrode is separated from the flat electrode 25 by a narrow intermediate space 31 and is also in this example interrupted at one point to provide space for a connecting strip 32 for the flat electrode. It is also possible to provide such an interruption at several points.

As an alternative, the guard electrode can be made completely closed. In this case the electrical connection to the flat electrode must be provided differently, for example by means of a bushing through the electrode 25.

Figure 5:
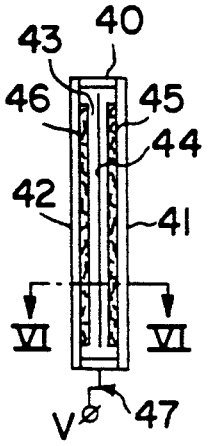
FIG. 5 and FIG. 6 show cross sections of a different dosimeter for a device according to the invention.
Figure 6:
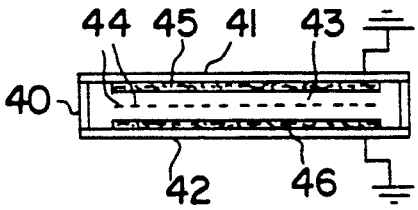

FIGS. 5 and 6 show an alternative embodiment of a two-dimensional dosimeter for a device according to the invention. The dosimeter shown again comprises a measuring chamber 43 enclosed by a frame 40 and two flat walls 41 and 42, and filled with gas which can be ionized by X-ray radiation. Thin parallel wires 44 are stretched in the measuring chamber in an area extending between the walls 41 and 42 and parallel thereto. A flat electrode 45, 46 is disposed on at least one of the walls, but preferably on both walls as shown in FIGS. 5 and 6. Relatively high strengths of field can be achieved with such a configuration. With high electric field strengths use can be made of the gas amplification phenomena.

The flat electrodes can, for example, be grounded, while the wires 44 can have a suitable potential V.

The wires extend through one of the frame parts and are preferably connected to conducting strips disposed on a flat flange 47 of the frame part extending in the plane of the wires. Again it is preferable for a print connector to mate with the flange 47.

The flat electrodes can again advantageously, in the manner described above and/or shown in FIG. 4, be provided, with a guard electrode and with one or more connecting points for electrical connections.

Figure 7:
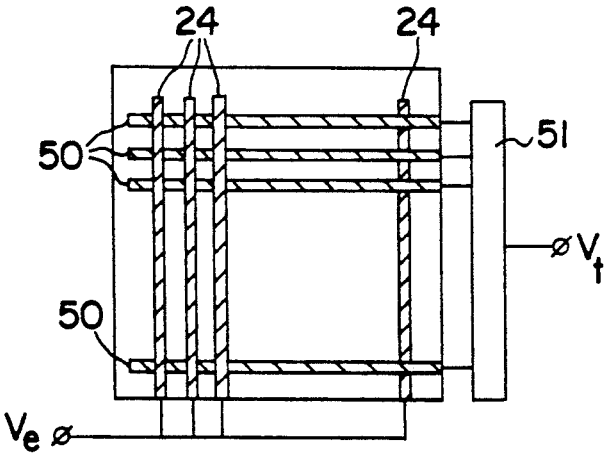
FIG. 7 shows yet another embodiment of a dosimeter for a device according to the invention.

FIG. 7 shows schematically another variant of a two-dimensional dosimeter for a device according to the invention. In this variant the flat electrode 25 of the embodiment shown in FIGS. 2 and 3 is replaced by e.g. equidistant electrode strips 50 which extend transversely to the strip-type electrodes 24.

In operation the strips 50 are therefore parallel to the slit of the slit diaphragm, so that at any instant during a scanning movement one or more strips 50 are exposed by the X-ray beam. In principle, ionization occurs only in the region of the exposed strips 50, so that the currents in the strip-type electrodes 25 at that instant represent only the ionization and thus the quantity of X-ray radiation in that region.

However, in practice there can be contributions from other regions, due to the effects of stray radiation, unless—as described above for the embodiment with one common counterelectrode—an anti-diffusing grid is placed between the body and the dosimeter.

If the strips 50 are connected to the operating voltage Vt by means of a multiplexer 51 in synchronization with the scanning movement of the X-ray beam, one by one or in groups of neighbouring strips, the contribution of any stray radiation to the output signals of the dosimeter is automatically eliminated.

Figure 8:
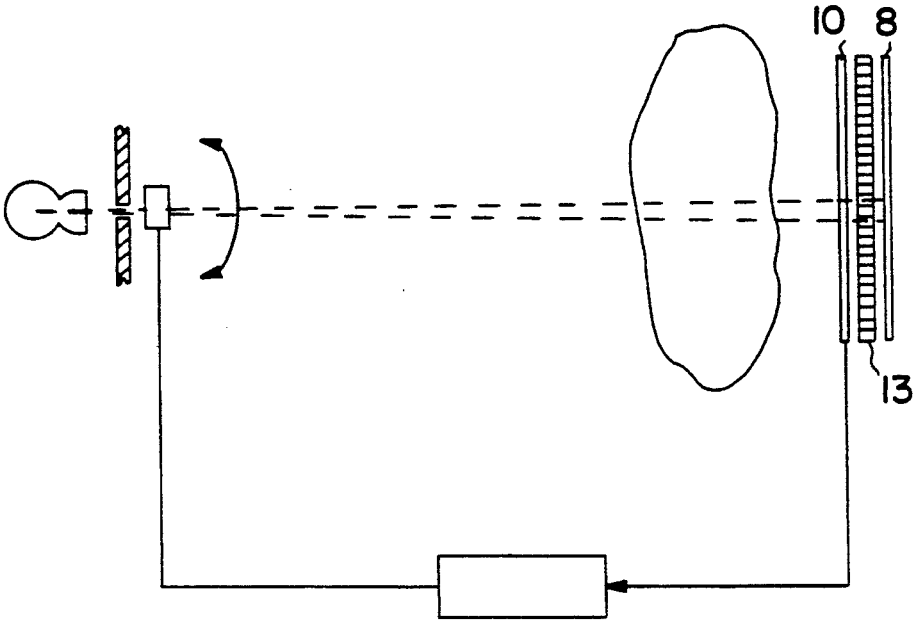
FIG. 8 shows a modification of FIG. 1.

This means that when a dosimeter according to the principle shown in FIG. 7 is used, the anti-diffusing grid can be placed between the two-dimensional dosimeter and the X-ray detector. With such an arrangement, any stray radiation which may have occurred in the dosimeter itself is also eliminated, or at least reduced. For the sake of completeness, FIG. 8 shows such an arrangement.

It is pointed out that such a modification can be used with a dosimeter of the type shown in FIGS. 5 and 6. Taut wires can also be used instead of strips.

As a result of the relatively large surface of the side walls, and as a result of the low thickness of the side walls for the purpose of having as little affect as possible on the incident X-ray radiation, two-dimensional dosimeters of the type described are sensitive to variations in atmospheric pressure. For such variations change the distance between the walls, and thus also the path length of the X-ray quantities through the measuring chamber.

If such variations are a problem in practice, use can be made of electrodes which are not disposed on the side walls, but on supports away from the side walls in the measuring chamber.

Figure 9:
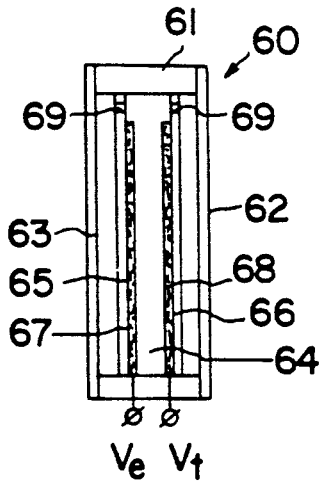
FIGS. 9 and 10 show two further embodiments of dosimeters for a device according to the invention.

An example is shown schematically in FIG. 9. A flat, box-shaped housing 60 has a frame 61 and two large side walls 62, 63 enclosing a measuring chamber 64.

The measuring chamber contains two parallel supports 65, 66 with the strip-type electrodes 67 and the opposite single counterelectrode or transverse counterelectrode strips 68. The part of the measuring chamber situated between the electrodes is connected to the spaces between the supports 65, 66 and the walls 62, 63, as shown schematically by openings 69 in the supports.

Here again, as in FIGS. 5 and 6, wires can be stretched between the electrodes 67, 68, which are then designed as single, flat electrodes. Each flat electrode can also again be provided with a guard electrode, as shown in FIG. 4.

It is pointed out that for each sector of the fan-shaped X-ray beam which can be influenced a single strip-type electrode or wire, or a group of neighbouring electrodes or wires can optionally be present. In the latter case the signals of the electrodes belonging to a group can be taken together, and can be averaged if necessary.

It is also pointed out that in the case of a swinging assembly of X-ray source, slit diaphragm and absorption device the image of a region of the slit of the slit diaphragm corresponding to a sector of the X-ray beam on a flat plane, as for example the input plane of a two-dimensional quantimeter, is theoretically not a straight strip, but a slightly curved strip of which the top and bottom ends lie more outwards than the central part.

If straight strip-type electrodes 24 are used, incorrect control signals can be produced as a result, particularly if only one or very few electrodes (or wires) are present per sector.

Figure 10:
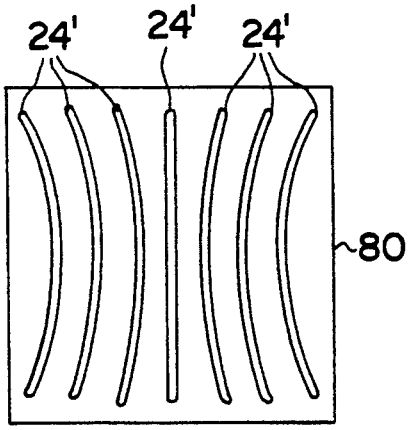

This problem can be solved if necessary by using curved electrodes, as schematically shown in FIG. 10.

FIG. 10 shows an electrode support 80 on which strip-type electrodes 24' are provided. The outermost electrodes are the most curved. The curve decreases towards the centre of the support, and the central electrode is completely straight. The above-described effect can be eliminated in this way.

Other distortions occurring in the image of a region of the slit of the slit diagram, which are due to the geometrical structure of the device for slit radiography and which could lead to incorrect control signals, can be compensated for in a similar manner.

It is pointed out that, following the above, various modifications are obvious to those skilled in the art. Such modifications are considered to be within the scope of the invention.

I claim:

1. A slit radiography assembly, which comprises:

an X-ray source;

an X-ray detector for recording radiation passing through a body being radiographed;

a slit diaphragm positioned between said X-ray source and said body for forming a substantially planar X-ray beam;

means for scanning said body with said planar X-ray beam;

an X-ray adsorption means for influencing said planar X-ray beam during scanning;

a two dimensional dosimeter for ionizing radiation corresponding to a width of said planar X-ray beam and to a height of total scanning distance, said dosimeter including one system of essentially parallel electrodes extending in a direction of scanning for forming sector-wise signals from detected quantities of X-ray radiation transmitted through said body and counterelectrode;

a control means for receiving signals from said parallel electrodes and for forming control signals corresponding to sector-wise signals from detected quantities of X-ray radiation; and means for transmitting said control signals to said X-ray adsorption means.

2. The slit radiography assembly as defined in claim 1 wherein said essentially parallel electrodes comprise striptype electrodes disposed on a support.

3. The slit radiography assembly as defined in claim 2 wherein said support is a side wall of the dosimeter.

4. A slit radiography assembly as defined in claim 2 wherein said support is disposed between opposite walls of said dosimeter.

5. The slit radiography assembly as defined in claim 2 wherein said counterelectrode is a flat two-dimensional electrode.

6. The slit radiography assembly as defined in claim 2 wherein said counterelectrode comprises a number of parallel counterelectrodes extending at right angles to the direction of scanning and is connected to a multiplexer device connecting one or more electrodes to an operating voltage in synchronization with the scanning movement.

7. The slit radiography assembly as defined in claim 6 wherein said parallel counterelectrodes are formed by taut wires.

8. The slit radiography assembly as defined in claim 6 wherein said parallel counterelectrodes are formed by strips disposed on a support.

9. The slit radiography assembly as defined in claim 1 wherein said essentially parallel striplike electrodes comprise wires stretched in a frame of said dosimeter.

10. The slit radiography assembly as defined in claim 1 wherein said counterelectrode is essentially enclosed by a guard electrode.

11. A slit radiography assembly as defined in claim 1 wherein said counter electrode is disposed on a sidewall of said dosimeter.

12. The slit radiography assembly as defined in claim 11 wherein said counterelectrode is disposed on a separate support.

13. The slit radiography assembly as defined in claim 1 and further including an anti-diffusing grid disposed between said dosimeter and said X-ray detector.

14. The slit radiography assembly as defined in claim 1 wherein said dosimeter is placed between the body and said X-ray detector and further including an anti-diffusing grid disposed between said dosimeter and said X-ray detector.

* * * * *